United States Patent [19]

Kaji et al.

[11] Patent Number: 4,733,479

[45] Date of Patent: Mar. 29, 1988

[54] METHOD OF CONTROLLING AN ELECTRIC CLOTHES DRYER INCLUDING AUTOMATIC LOAD DETECTION

[75] Inventors: Shinichi Kaji, Katsuta; Keiji Hikino, Hitachi; Shin Nakamura, Hitachi; Tsunetoshi Komatsu, Hitachi, all of Japan

[73] Assignee: Hitachi, Ltd., Tokyo, Japan

[21] Appl. No.: 922,714

[22] Filed: Oct. 24, 1986

[30] Foreign Application Priority Data

Oct. 25, 1985 [JP] Japan ..... 60-237334

[51] Int. Cl.[4] ..... F26B 25/22

[52] U.S. Cl. ..... 34/31; 34/43; 34/50; 34/53

[58] Field of Search ..... 34/31, 48, 50, 53, 55; 324/65 R, 65 P

[56] References Cited

U.S. PATENT DOCUMENTS 4,525,937 7/1985 Strandberg et al. ..... 34/48
4,531,305 7/1985 Nagayasu et al. ..... 34/48
4,640,022 2/1987 Suzuki et al. ..... 34/48

FOREIGN PATENT DOCUMENTS 58-89297 5/1983 Japan .

*Primary Examiner*—Albert J. Makay
*Assistant Examiner*—David W. Westphal
*Attorney, Agent, or Firm*—Antonelli, Terry & Wands

[57] ABSTRACT

Under the rated load amount of "Normal" and "Extra" drying degrees, a drying process carried out after the detections of the plurality of resistance values a passing time of at least one resistance value selected from among of the plurality of resistance values is predicted is carried out. The hot air operation time in accordance with the measured time is calculated, and the hot air operation during the calculated hot air operation time is carried out. When under the small load amount, a drying process is carried out in the form of a hot air operation by calculating a necessary time for "Damp" drying degree under a small load amount in accordance with a time for passing a predetermined resistance value after a lapse of a constant time from the start of drying operation. When one of "Semi", "Normal" and "Extra" drying degrees under the small load amount is selected, a hot air operation is carried out at a constant time according to the calculated time for "Damp" drying degree.

9 Claims, 6 Drawing Figures

METHOD OF CONTROLLING AN ELECTRIC CLOTHES DRYER INCLUDING AUTOMATIC LOAD DETECTION

BACKGROUND OF THE INVENTION (1) Field of the Invention

The present invention relates to a method of controlling an electric clothes dryer wherein a wide range of degrees of drying of clothes can be selected regardless of the amount of the clothes involved. The method of controlling the electric clothes dryer provides a drying operation having "Normal" and "Extra" drying degrees for a rated amount of clothes and "Damp", "Semi", "Normal" and "Extra" drying degrees for a small amount of clothes.

2. Description of the Prior Art

In an exhaust type electric clothes dryer having relatively low humidity exhaust air, a humidity sensor is provided in an exhaust duct of the electric clothes dryer. (Japanese Patent Laid-Open No. 89297/1983). However, the humidity sensor thereof falls short of the desired detecting capacity. In particular, the detection of a high drying degree of the clothes using the humidity sensor is impossible.

In other words, for a desired high drying degree of the clothes, for example "Normal" and "Extra" drying degrees for a rated load, the electric resistance value of the humidity sensor becomes close to the rated electric resistance value thereof, so that the sensor is unable to discriminate properly between humidity values for dry conditions. Therefore, it is impossible to accurately detect different values of humidity using the humidity sensor because the output electric resistance values of the humidity sensor change rapidly for different values of humidity in the dry range.

In addition, for "Damp", "Semi", "Normal" and "Extra" drying degrees for a small load, it is impossible to detect the electric resistance value of the humidity sensor because of the rapid change of the electric resistance value of the humidity sensor for such small loads.

Accordingly, the electric clothes dryer of the prior art has defects in the drying operation control, in particular at the high drying degree for a rated load of clothes and at the drying degree for a small load of clothes, so that it cannot provide a wide drying degree selection.

SUMMARY OF THE INVENTION

An object of the present invention is to provide to a method of controlling an electric clothes dryer wherein a wide drying degree of the clothes can be selected regardless of the load of the clothes involved.

Another object of the present invention is to provide a method of controlling an electric clothes dryer wherein a "Normal" drying degree for a rated load of clothes can be carried out effectively.

Further object of the present invention is to provide a method of controlling the drying operation of an electric clothes dryer wherein an "Extra" drying degree for a rated load of clothes can be carried out effectively.

Still another object of the present invention is to provide a method of controlling an electric clothes dryer wherein the direction of a "Damp" drying degree for a small load of clothes can be carried out effectively.

A still further object of the present invention is to provide a method of controlling an electric clothes dryer wherein "Semi", "Normal" and "Extra" drying degrees for a small load of clothes can be determined according to the detection of the "Damp" drying degree.

In accordance with the present invention, a method of controlling an electric clothes dryer includes the steps of drying the clothes in a rotative drum by sending hot air into the rotative drum, detecting the moisture content of the clothes according to a plurality of detected electric resistance values by use of a humidity sensor, controlling the drying degree of the clothes according to the plurality of electric resistance values by means of a microcomputer, and carrying out a hot air operation until one of the plurality of electric resistance values is detected.

In accordance with a selected drying degree of the load of the clothes to be dried, a step of carrying out a drying process is effected either by (1) after the detection of a plurality of electric resistance values, measuring the time between detection of two electric resistance values selected from among the plurality of electric resistance values, calculating a predicted hot air operation time in accordance with the measured time, and carrying out the hot air operation during the calculated hot air operation time, or (2) carrying out a hot air operation by calculating a necessary time for a constant drying degree in accordance with a time for reaching a predetermined electric resistance value, after a lapse of a constant time from the start of the drying operation.

After such a drying process is carried out, a blower (Cool down) operation is carried out for a constant time determined according to the respective drying operations, and thereby the drying operation of the clothes is completed automatically.

After carrying out the drying process of the hot air operation by calculating the necessary time for a constant drying degree in accordance with the time for passing the predetermined electric resistance value after a lapse of the constant time from the start of the drying operation, when the predicted drying degree rather than the constant drying degree is selected, a hot air operation for a constant time on the basis of a determined drying degree is carried out.

The drying process (1) is carried out for a rated load a "Normal" drying degree or "Extra" drying degree. The drying process (2) is carried out for a small load selected from at least one of the group of "Damp" drying degree, "Semi" drying degree, "Normal" drying degree and "Extra" drying degree.

According to the present invention, by the drying operation controlling method utilizing a plurality of electric resistance values of the humidity sensor portion and the software for effecting control on the basis of the plurality of the electric resistance values of the humidity sensor portion, a wide range of drying of the clothes in the electric clothes dryer can be attained and "Normal" and "Extra" drying degrees for a rated load and also "Damp", "Semi", "Normal" and "Extra" drying degrees for a small load of clothes can be attained. Therefore, the efficient operation of the electric clothes dryer of the present invention can attained effectively in order to achieve automatic drying.

DETAILED DESCRIPTION OF THE PREFERRED EMBODIMENT

Figure 2:
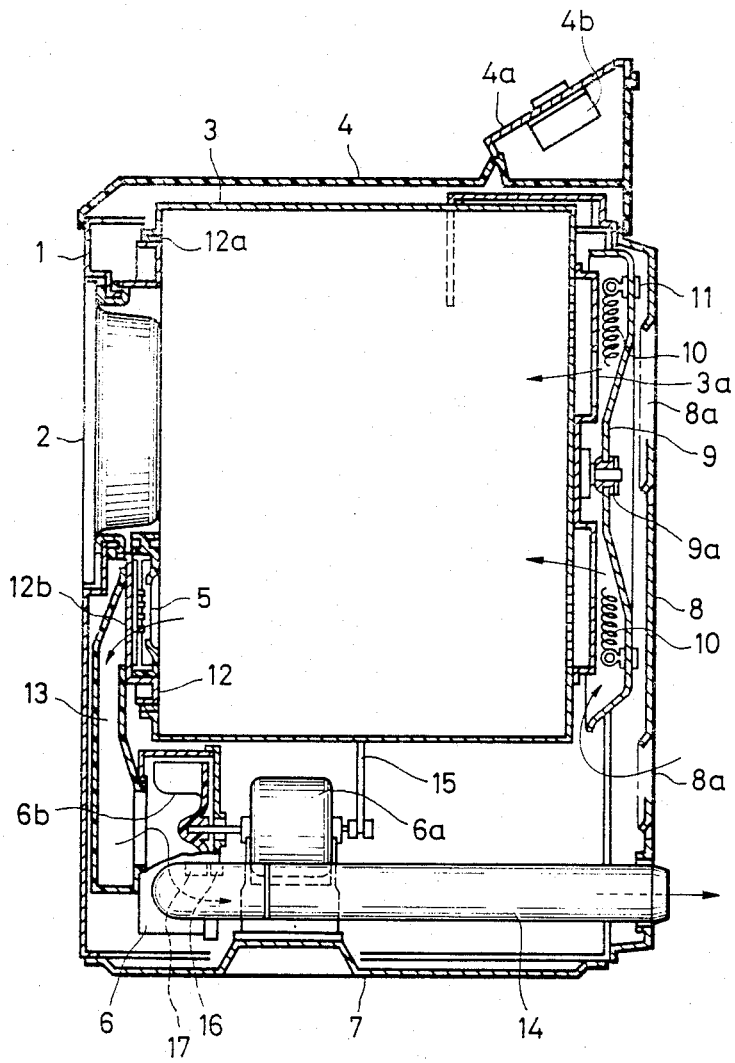
FIG. 2 is a cross-sectional view of an electric clothes dryer according to one embodiment of the present invention.

One embodiment of an exhaust type electric clothes dryer of the present invention will be explained in accordance with FIG. 2. A casing is constituted by an outer frame 1, an outer frame base 7, and a rear cover with an air inlet 8*a*. A rotative drum 3 is housed in this casing, rotatably supported by a drum support 12 and a drum holder 9*b*. The drum support 12 has a slider 12*a* secured to the outer frame 1, and the drum holder 9*b* is mounted on a heater case 9 which houses a heater 10 through heater supporting plates 11. The rotative drum 3 has a heat-insulating plate 3*a* provided between the rotative drum 3 and the heater 10.

A door 2 is mounted on the outer frame 1. The door 2 can be opened and closed when the clothes are taken in and out the drum 3. A filter 5 is arranged in an exhaust inlet 12*b* of the drum support 12 on the drum sides so as to collect the lint, raveling, waste threads and similar fine waste coming from the clothes.

Air in the drum 3 is introduced into a blower 6 through the filter 5 and then discharged to the outside of the machine body through an exhaust duct 14. The blower 6 has a motor 6*a* and a fan 6*b*. A belt 15 transmits rotations of the motor 6*a* to the rotative drum 3. A top cover 4 is mounted on the machine body and provides a control panel portion 4*a* on which an electric control unit 4*b* is mounted.

A humidity sensor portion 16 is provided within the exhaust duct 14 and detects the drying degree of the clothes. A temperature adjusting thermostat 17 is provided with the exhaust duct 14 and adjusts the exhaust temperature.

A basic operation of this electric clothes dryer is as follows. First, upon turning-on the power source, the motor 6*a* is energized to rotate the drum 3 and the fan 6*b*, and at the same time, the heater 10 is energized to generate heat. In the rotating of the fan 6*b*, air is sucked from the air inlet 8*a*, and the air advances along the direction of the arrow in the drawing to reach the heater 10 so as to be heated thereby. The thus heated air is introduced into the drum 3 to dry the clothes therein.

Further, the air containing moisture is passed through the filter 5 so as to remove lint, raveling, waste threads and similar fine waste, and the air which has passed through the filter 5 is supplied to the exhaust duct 14 through the fan 6*b* so as to be discharged therefrom outwardly. The humidity sensor portion 16 and the temperature adjusting thermostat 17, respectively, are provided in the exhaust duct 14. A thermostat 18 is provided in the vicinity of the heater 10 for preventing the temperature of the heater 10 from rising abnormally.

In the embodiment of the present invention, an organic high polymer type humidity sensor or a variable electric resistance type humidity sensor is used therein as a humidity sensor. Such a humidity sensor has characteristics such that the electric resistance values between the electrodes thereof are variable and the electric resistance values of the humidity sensor becomes higher in proportion to the height of the drying degree of the clothes, i.e. the resistance value increases with decrease in humidity.

The humidity sensor detects the moisture content in the rotative drum 3 in which the moisture content of the clothes is indicated by the electric resistance value of the humidity sensor and then is measured. The microcomputer 21 controls the drying degree of the clothes according to the plurality of the detected electric resistance values of the humidity sensor portion 16.

Figure 6:
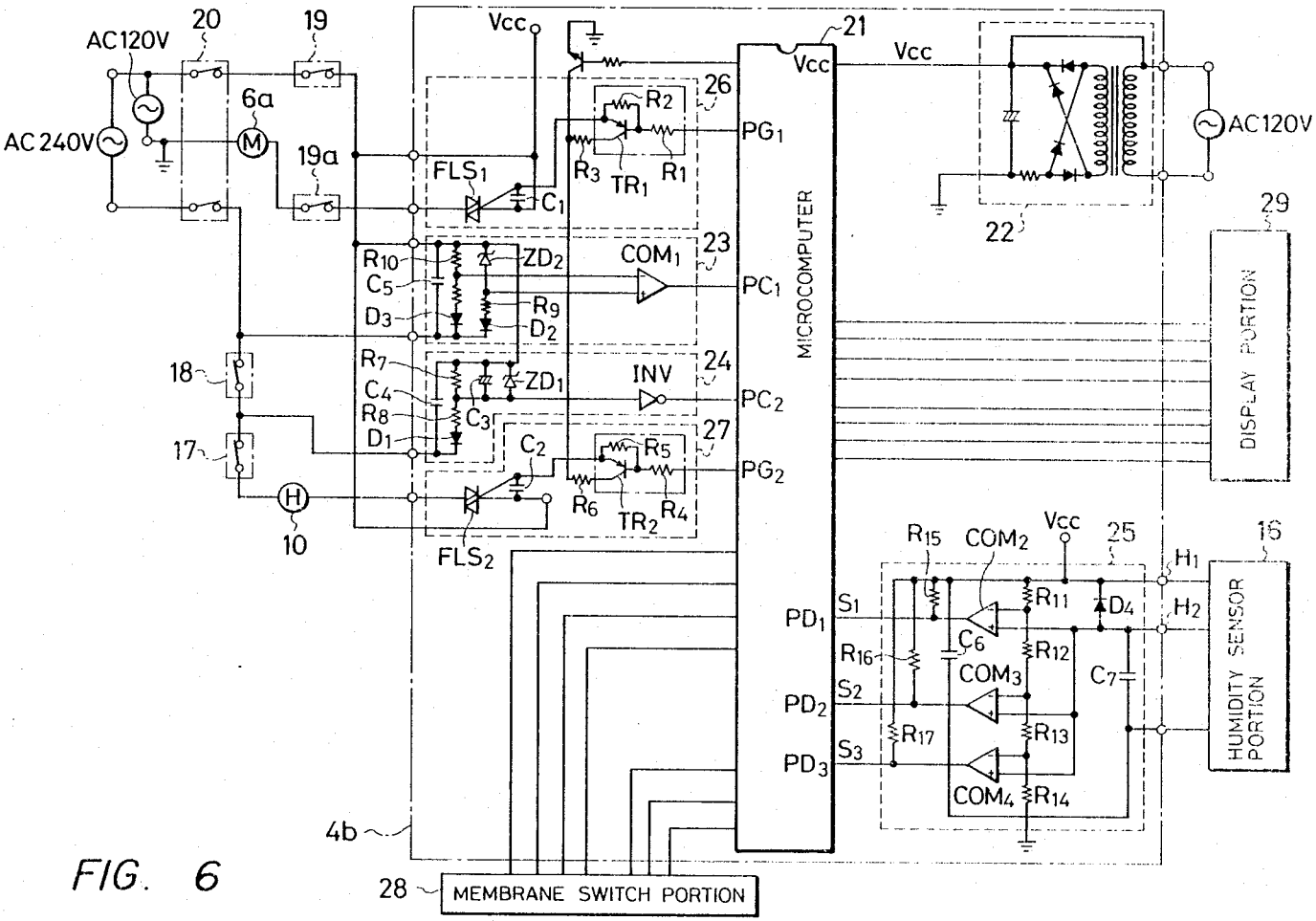
FIG. 6 shows an electric circuit diagram of an electric control apparatus of an electric clothes dryer according to one embodiment of the present invention.

Referring to other drawings, description will be made as to an arrangement and an operation of the electric control unit 4*b*. FIG. 6 is an electric circuit diagram of an embodiment of the electric control apparatus according to one embodiment of the present invention, including the electric control unit 4*b* and peripheral electric circuits thereof.

In FIG. 6, the reference numerals 19 and 19*a* designate door switches each provided between the outer frame 1 and the door 2 and each arranged to be opened/closed in response to opening/closing of the door 2 respectively, and 20 designates a power switch provided on the control panel portion 4*a* for turning on/off the power source.

One terminal of an A.C. source of 240 V is connected to the electric control unit 4*b* through the power switch 20 and the door switch 19, while the other terminal of the same is connected to the electric control unit 4*b* through a series circuit constituted by the power switch 20, the thermostats 17 and 18, and the heater 10.

One terminal of an A.C. source of 120 V is commonly connected to the one terminal of the A.C. source of 240 V, and the other terminal of the A.C. source of 120 V is connected to the electric control unit 4*b* through a series circuit constituted by the motor 6*a* and the door switch 19*a*.

In the electric control unit 4*b*, the reference numeral 21 designates a known microcomputer which may be, for example, a HMCS44C type microcomputer made by Hitachi, Ltd. It is a matter of course that any other microcomputer may be used as long as it has the same performance as that of the above-mentioned one.

The electric control unit 4*b* is provided with a rectifier unit 22 which receives an A.C. voltage of 120 V to generate a D.C. voltage Vcc to be supplied to the microcomputer 21 of the electric control unit 4*b*. This A.C. voltage of 120 V may be commonly supplied from an the same A.C. source of 120 V applied to the motor 6*a*. The rectifier unit 22 is a well-known circuit constituted by a transformer, a full wave rectifier diode bridge, and a filter capacitor. A constant voltage circuit may be connected to an output of the rectifier unit 22.

There are provided a large number of input and output ports in the microcomputer 21. Of the ports, an input port $PC_1$ is provided for detecting the voltage of the A.C. source of 240 V for energizing the heater 10 and connected to an overvoltage detecting circuit 23 which is arranged such that when a voltage of the A.C. source of 240 V is applied to the heater 10, the voltage is also applied to an input of the overvoltage detecting circuit 23.

An input port $PC_2$ is connected to a heater temperature detecting circuit 24 for detecting a status (an opened or closed status) of the thermostat 18 provided in the vicinity of the heater 10. Input ports $PD_1$, $PD_2$ and $PD_3$ are connected to terminals $S_1$, $S_2$ and $S_3$ of a humidity detecting circuit 25, respectively.

The humidity detecting circuit 25 detects a voltage across the humidity sensor portion 16 provided in the exhaust duct 15 and produces an indication of the humidity of exhaust air in values of three stages at the output terminal $S_1$, $S_2$ or $S_3$.

An output port $PG_1$ is connected to a motor drive control circuit 26 which is serially connected between the motor 6a and the A.C. source of 120 V and arranged to open/close the motor drive control circuit 26 in response to an output signal from the output port $PG_1$ of the microcomputer 21.

In addition to the circuits described above, a membrane switch portion 28 and a display section 29 are connected to the microcomputer 21 through a plurality of lines, respectively.

In the membrane switch portion 28, there are provided switches for selecting various drying processes or drying modes and the start switch for instructing start of a drying operation to the microcomputer 21. The display section 29 is provided for visually displaying the status of the drying process or for displaying a warning of an abnormal temperature. These displays are set in different fashions in the various electric clothes dryers depending on the different type thereof.

The operation of this electric control apparatus will be described more in detail.

In the arrangement as described above, assume now that the power switch 20 is turned on, the clothes which have been washed are put into the drum 3, and the door 2 is closed. Thus, the door switches 19 and 19a are closed.

If the start switch in the membrane switch portion 28 is turned on after a desired drying process has been designated by a selected one of the switches of the membrane switch portion 28, a start signal for starting the designated drying process is applied from the membrane switch portion 28 to the microcomputer 21 which in turn applies a low level output to the output ports $PG_1$ and $PG_2$ in response to the received start signal.

When the low level output is applied to the base of the transistor $TR_1$ through a resistor $R_1$ in the motor drive control circuit 26, the transistor $TR_1$ is turned on, so that a current is allowed to flow into a gate circuit of a triode A.C. switch $FLS_1$ from a D.C. source voltage Vcc so as to turn on the triode A.C. switch $FLS_1$.

A capacitor $C_1$ is provided for preventing miss ignition of the triode A.C. switch $FLS_1$. The respective electric resistance values of the resistors $R_1$ and $R_2$ are set in accordance with the operation potential for the turning on/off of the transistor $TR_1$, while the electric resistance value of a resistor $R_3$ is determined in accordance with a trigger current flowing in the triode A.C. switch $FLS_1$.

When the triode A.C. switch $FLS_1$ is turned on, the motor drive control circuit 26 is established to energize the motor 6a so as to drive the drum 3 and cause the fan 6b to rotate. Simultaneously with the application of the low level output to the transistor $TR_1$, the low level output received by the output port $PG_2$ is applied to a base of a transistor $TR_2$ of the heater driver control circuit 27 to turn on the transistor $TR_2$ to thereby allow a current to flow into a gate circuit of a triode A.C. switch $FLS_2$ from the D.C. source voltage Vcc to turn on the triode A.C. switch $FLS_2$.

Resistors $R_4$, $R_5$ and $R_6$ and a capacitor $C_2$ act in the same manner as those of the motor drive control circuit 26. When the triode A.C. switch $FLS_2$ is turned on, the heater driver control circuit 27 is established to allow a current to flow into the heater 10 from the A.C. source of 240 V.

The thermostats 17 and 18 normally closed and connected in series to the heater driver control circuit 27 are arranged to be opened to thereby break the heater driver control circuit 27 in the case where an exhaust air temperature and a heater temperature exceed predetermined values, respectively. When the current flows into the heater 10, hot air heated by the heater 10 is introduced into the rotative drum 3 by the fan 6b so as to be applied for the drying of clothes in the rotative drum 3.

Figure 3:
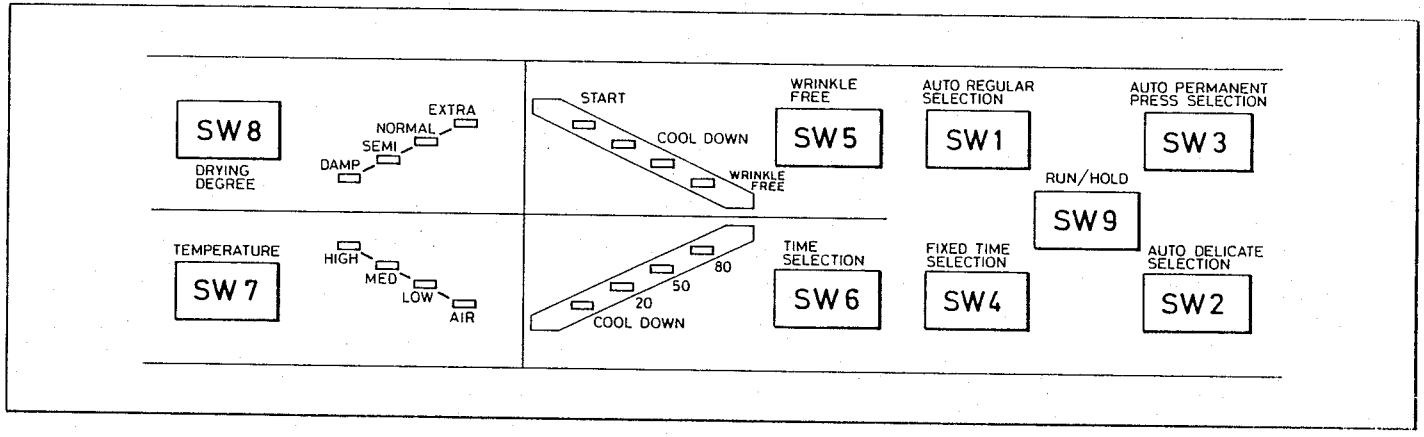
FIG. 3 is a detailed view of a control panel portion of an electric clothes dryer according to one embodiment of the present invention.

An outside appearance of the control panel portion 4a of one embodiment of the present invention will be illustrated in detail in FIG. 3. In FIG. 3, the drying degree of the clothes is chosen by a switch SW 8. Four different ranges of drying degree of the clothes are available in this embodiment and one of them may be selected according to an operator's choice.

(1) "Damp" . . . drying degree having humidity demand for ironing the clothes. 83 (90/108×100) % drying degree.

(2) "Semi" . . . drying degree having humidity for the clothes being worn usually. 93 (100/108×100) % drying degree.

(3) "Normal" . . . drying degree higher than that of "Semi" drying degree. 96 (100/108×100) % drying degree.

(4) "Extra" . . . drying degree as dry bone clothes to perfectly dry the clothes. 100 (108/108×100) % drying degree.

These drying degrees of the clothes increase in sequence (1), (2), (3) and (4).

A detection of the electric resistance values and utilization thereof by the humidity sensor portion 16 and the drying operation control method will be explained below in accordance with one embodiment of the present invention.

Figure 1:
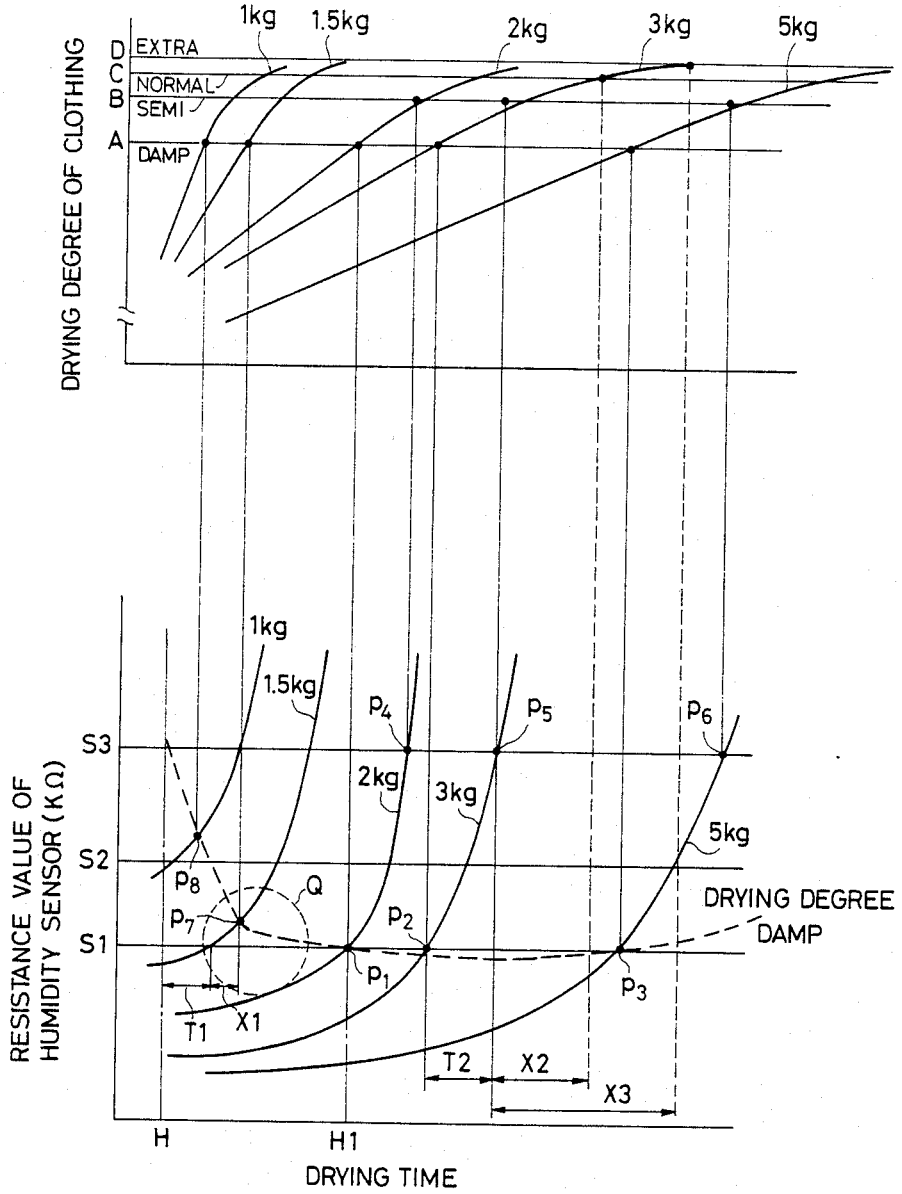
FIG. 1 shows relationships between drying time and drying degree of the clothes, and electric resistance value of a humidity sensor and the drying time of the clothes of an electric clothes dryer according to one embodiment of the present invention.

FIG. 1 shows a relationship between the drying time of the clotes and the drying degree of the clothes, and also a relationship between the electric resistance value of the humidity sensor and the drying time of the clothes, for various loads of clothing.

An automatic drying operation completion system of the electric clothes dryer according to one embodiment of the present invention is carried by the following method. The automatic drying operation completion system includes a hot air operation and a blower (Cool down) operation from the start of a drying operation, when the switch SW4 or SW6 for time selection as shown in FIG. 3 is not selected by the operator.

The following four drying degrees of the clothes show the ranges of drying degree which may be selected using the switch SW 8.

"Damp" . . . drying degree level A of the clothes.

"Semi" . . . drying degree level B of the clothes.

"Normal" . . . drying degree level C of the clothes.

"Extra" . . . drying degree level D of the clothes.

(a) for a rated load

The rated load of clothes of the exemplary electric clothes dryer of the embodiment of the present invention is about 2–5 Kg.

This rated load of clothes is determined automatically for those loads for which neither of the points S1 or S2, which represent the electric resistance value of the humidity sensor, is detected within the drying time H1 in FIG. 1.

(a-1) "Damp" and "Semi" drying degrees.

The "Damp" drying degree level A and "Semi" drying degree level B under the rated load are stopped and the blower (Cool down) operation is initiated after the detection of the points S1 and S3, which represent electric resistance values of the humidity sensor, respectively.

The humidity sensor indicates the humidity of the exhaust air according to the electric resistance value level S1 of the humidity sensor at each rated load amount. For example, as shown in FIG. 1, under the rated load of clothes of 2 Kg, 3 Kg and 5 Kg, "Damp" drying degree level A is stopped and the blower (Cool down) operation initiated after the detection of the points $p_1$, $p_2$ and $p_3$, respectively.

Under the rated load of clothes of 2 Kg, 3 Kg and 5 Kg, "Semi" drying degree level B is stopped and the blower (Cool down) operation is initiated after the detection of the points $p_4$, $p_5$ and $p_6$, respectively.

(a-2) "Normal" and "Extra" drying degrees.

At "Normal" drying degree level C and "Extra" drying degree level D for a rated load, the electric resistance value of the humidity sensor becomes close to the rated electric resistance value of the humidity sensor. Therefore it is impossible to detect the humidity on the basis of the electric resistance value of the humidity sensor with accuracy because of the rapid change of the electric resistance value of the humidity sensor under these conditions.

Accordingly at "Normal" drying degree level C and "Extra" drying degree level D conditions for the rated load, the electric clothes dryer is controlled as described in the following in one embodiment of the present invention.

Under the rated load for a "Normal" drying degree level C and "Extra" drying degree level D, the time between the point S1 and the point S3 on the load line becomes longer in accordance with the increase of the size of the load of clothes. For example, under the rated load of 3 Kg, the time T2 correlates closely with the time X2 needed for reaching the "Normal" drying degree level C from the "Semi" drying degree level B and also correlates closely with the time X3 needed for reaching the "Extra" drying degree level D from the "Semi" drying degree level B, respectively.

The time T2 is measured and the measured time T2 is correlated to a regression linear line formula in the microcomputer 21. The time T2 is measured and the measured time T2 is correlated to a regression linear line formula in the microcomputer 21. The time X2 is obtained by the regression linear line formula $X2=aT2+b$ through the microcomputer 21, wherein a and b are constants. The time X3 is obtained by the regression linear line formula $X3=cT2+d$ through the microcomputer 21, wherein c and d are constants.

Thus the electric clothes dryer operates under a hot air condition during such an obtained time X2 or X3 under the rated load amount of "Normal" or "Extra" drying degree and then stops the heater 10, and thereafter the blower (Cool down) operation is started.

Figure 4:
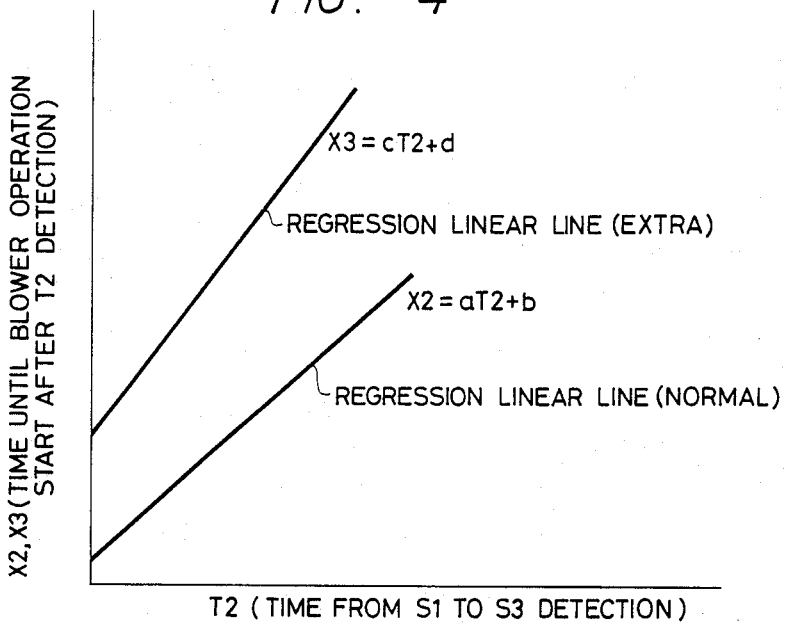
FIG. 4 shows relationship graphs of regression linear lines between time T2 and times X2 and X3, respectively.

FIG. 4 shows normal regression linear line graphs indicating the relationship between the time T2 (the time from the point S1 to the detection of the point S3), and the time X2 (the time "Normal" drying degree level C until the blower operation start after the detection of the time T2) or X3 ("Extra" drying degree level D until the blower operation start after detection of the time T2).

(b) For a small load

In the case of a small load drying of the clothes (less than about 2 Kg) in the electric clothes dryer in one embodiment of the present invention produces a blow-through phenomenon of hot air because the hot air hardly touches the clothes in the rotative drum 3 on account of the small load of clothes.

Owing to the above hot air blow-through phenomenon, the electric resistance value of the humidity sensor portion 16 in the case of the small amount of clothes shows a high value in comparison with the condition under the rated load of the clothing, thereby the drying time under the small load condition cannot be detected accurately by the above stated control method for the rated load of clothes.

For example, under the small load amounts of 1.5 Kg and 1 Kg, the curves between drying time and the electric resistance value of the humidity sensor cross the curve of "Damp" drying degree at the points $p_7$ and $p_8$, respectively as shown in FIG. 1. The points $p_7$ and $p_8$ of the electric resistance values of the humidity sensor for a small load of clothes are higher than the points $p_1$, $p_2$ and $p_3$ for the rated load of clothes. The points $p_7$ and $p_8$ at the intersections of the curve drying time and the electric resistance value of the humidity sensor with respect to the load amounts of 1.5 Kg and 1 Kg and the curve of the "Damp" drying degree are above the electric resistance value S1 of the humidity sensor.

Figure 5:
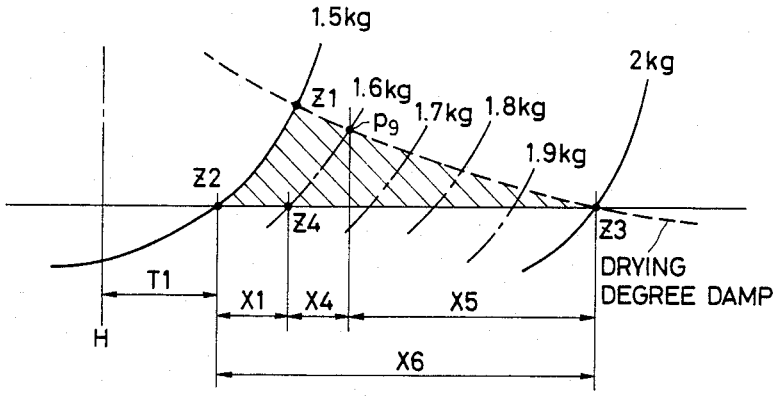
FIG. 5 is an enlarged view of the Q portion of FIG. 1 and shows a relationship diagram for controlling drying for a small load of clothes.

The drying operation control method for a small load of the clothes in one embodiment of the present invention is carried out with the following control method. FIG. 5 shows an enlarged partial portion of the Q portion as shown in FIG. 1.

A drying operation control for a load of clothes between about 1.5–2 Kg is carried out as follows. First of all, for example as shown in FIGS. 1 and 5, when "DAMP" drying degree level A is selected, the load amount of the clothes of 1.5 Kg, the point Z2 is reached after a time T1 for reaching the point Z2 following a lapse of the time H from the start of the drying operation. For a load of 1.5 Kg, the time between from the point Z2 to the point Z1 or $p_7$ is decided as a function of the time T1. In other words, the time between from the point Z2 to the point Z1 is guessed at on the basis of the time T1.

For a small load between about 1.5–2 Kg, the relationship between the electric resistance value of the humidity sensor portion 16 and the drying time forms a figure of a substantially triangular form having the points Z1, Z2 and Z3 in which the point Z1 is an apex, and represents the point when the drying degree of the load amount of the clothes of 1.5 Kg reaches the "Damp" drying degree level A.

In FIG. 5, the following formula is effected.

$$X6=X1+X4+X5$$

Wherein X6 is the time between the point Z2 to the point Z3, X1 is the time between the point Z2 to the point Z4, X4 is the time at the load of 1.6 Kg after a lapse of time X1 or from the point Z4, and X5 is a time for reaching the point Z3 after a lapse of the time X4.

The time X6 is a drying time between the load amount of 1.5 Kg and the load amount of 2 Kg and has a fixed or constant time in the electric clothes dryer. The time X5 is guessed at from the experimental data of the curve of "Damp" drying degree.

The time X5 is a function of the time X4 and in this embodiment the expression is effected X5=4.5X4. Therefore, the following relationship formula is effected.

$$X6=X1+X4+4.5X4$$

$$X4=1/5.5(X6-X1)$$

According to the above formula, the time X4 can be guessed at from the time X1. By the hot air operation during the obtained time X4, the drying degree of the load amount of 1.6 Kg can be attained. The point $p_9$ represents the electric resistance value of the humidity sensor portion 16 at "Damp" drying degree of the load amount of 1.6 Kg. The relationship between the time X4 and X1 is shown in the following as a general.

$$X4=e(f-X1)$$

Wherein, e and f are constants.

The above general formula is effected by the software of the microcomputer 21. The control method for the hot air operation time to "Damp" drying degree level A of a small load between about 1.5 Kg–2 Kg is guessed at during the time X1.

The hot air operation time at the load amounts of 1.7 Kg and 1.8 Kg, 1.9 Kg, for example, will be guessed at from above general formula.

"Semi" drying degree level B, "Normal" drying degree level C and "Extra" drying degree level D drying operations under a small load are carried out respectively at a fixed time operation, which is a total amount of the time X1 for "Damp" drying degree level A plus a predetermined time. The predetermined time is decided respectively in advance in "Semi", "Normal" and "Extra" drying degrees.

A drying operation control for a smaller load between about 1–1.5 Kg is carried out as follows. The electric resistance value S2 is decided smaller the electric resistance value point $p_8$ of the load amount of the clothing of 1 Kg and in which the curve between drying time and the electric resistance value of the humidity sensor crosses the curve of "Damp" drying degree A. In the condition under the smaller load between about 1–1.5 Kg, the point S2 is used in place of the point S1 which is used in the condition under the small load between about 1.5–2 Kg.

The drying operation control method in the condition under the smaller load between about 1–1.5 Kg is carried out with the same drying operation control method as used under the small load between 1–1.5 Kg.

After the hot air operation, a blower operation, the so-called "Cool down" operation, is started. The "Cool down" operation operates to cool the clothes and also to "fluff" the clothes, and then the drying operation of the clothes is completed automatically.

The greater the load amount of the clothes the more will be the quantity of heat in the clothes therefore the cooling of the clothes becomes more difficult.

In the drying operation control method for an electric clothes dryer the above embodiment of the present invention, the blower (Cool down) operation time in "Normal" drying degree level C and "Extra" drying degree level D under the rated load is longer, and the blower (Cool down) operation time in the others is shorter than that of the former. The meticulous considerations are attempted in above embodiment of the present invention.

The points, which represent the electric resistance values of the humidity sensor portion 16, may be more than two points, then an accuracy under the small load amount drying operation control or under the small load amount drying operation control can be improved sufficiently.

In the above embodiment of the present invention, four ranges of drying degrees such as "Damp", "Semi", "Normal" and "Extra" drying degrees maybe selected. However, it is possible for three ranges of drying degrees, namely "Damp", "Normal" and "Extra" drying degrees, to be selected, in which the "Semi" drying degree is omitted.

Under the small load amount in the embodiment of the present invention, two classifications of the load amount which are the small and the smaller load amounts, are described for the drying operation control. However, as a result of the above considerations, it is possible that a small load amount can be defined as a smaller load amount.

Further, the software of the microcomputer 21 of the present invention is programmed separately for the hot air operation time and/or constants of the regression linear lines such as "Extra" drying degree and "Normal" drying degree under the rated load amount and also "Damp", "Semi", "Normal" and "Extra" drying degree under the small or smaller load amount of the clothes so as to meet the various specifications of the electric clothes dryer of application for another areas having the different heater capacities.

The drying operation control of the electric clothes dryer can be correlated sufficiently to the change of electric resistance value concerning the time of humidity sensor portion 16, even when the heater capacity changes, in which the electric resistance value with respect to a lapse of time is variable according to the differential heater capacities.

What is claimed is:

1. A method of controlling an electric clothes dryer including the steps of drying clothes in a rotative drum by supplying hot air to the rotative drum; detecting the moisture content of the clothes by means of a humidity sensor which produces respective resistance values for different amounts of detected humidity; and controlling the duration of the drying of the clothes by means for a microcomputer on the basis of the resistance value of said humidity sensor and the amount of the load of the clothes, including measuring the drying time until a predetermined first resistance value of said humidity sensor is reached, determining whether the load of the clothes is a rated load or a small load depending upon whether or not said measured drying time for reaching said first predetermined resistance value exceeds a first predetermined amount of time, respectively, and determining the required hot air operation time in accordance with a first control method for a rated load of clothes and a second control method for a small load of clothes.

2. A method according to claim 1, further including, following completion of the required hot air operation, carrying out a blower operation for a constant time the duration of which is determined according to whether the load of said clothes is a rated load or a small load.

3. A method according to claim 1, wherein said first control method for a damp degree of clothes drying comprises stopping the hot air operation when said first predetermined resistance value of said humidity sensor is detected.

4. A method according to claim 1, wherein said first control method for a semi-dry degree of clothes drying comprises stopping the hot air operation when a second predetermined resistance value, which is higher than said first predetermined resistance value of said humidity sensor is detected.

5. A method according or claim 4, wherein said first control method for a normal-dry or extra dry degree of clothes drying comprises measuring the elapsed time between detection of said first and second predetermined resistance values of said humidity sensor, determining a constant time period on the basis of said measured elapsed time, and stopping said hot air operation when said constant time period has elapsed following detection of said second predetermined resistance value of said humidity sensor.

6. A method according to claim 1, wherein said second control method for a damp degree of clothes drying comprises measuring the period of time which elapses from the start of the hot air operation until said first predetermined resistance value of said humidity sensor is detected, determining a constant time period on the basis of said measured elapsed time, and stopping said hot air operation when said constant time period has elapsed following detection of said first predetermined resistance value of said humidity sensor.

7. A method according to claim 6, wherein said second control method for a semi-dry, normal-dry or extra dry degree of clothes drying comprises continuing said hot air operation for a fixed period of time from the start of said operation.

8. A method according to claim 1, wherein said second control method for a damp degree of clothes drying comprises measuring the period of time which elapses from the start of the hot air operation until a second predetermined resistance value different from said first predetermined resistance value of said humidity sensor is detected, determining a constant time period on the basis of said measured elapsed time, and stopping said hot air operation when said constant time period has elapsed following detection of said second predetermined resistance value of said humidity sensor.

9. A method according to claim 8, wherein said second control method for a semi-dry, normal-dry or extra dry degree of clothes drying comprises continuing said hot air operation for a fixed period of time from the start of said operation.

* * * * *